United States Patent [19]

Hardy

[11] 4,381,688

[45] May 3, 1983

[54] CUTTER FOR ROTARY CUTTING MACHINE

[75] Inventor: Philip M. Hardy, Stockport, England

[73] Assignee: The Stampiton Group of Companies Limited, England

[21] Appl. No.: 296,465

[22] Filed: Aug. 26, 1981

Related U.S. Application Data

[63] Continuation-in-part of Ser. No. 146,661, May 5, 1980, abandoned.

[30] Foreign Application Priority Data

May 24, 1979 [GB] United Kingdom ..... 7918127

[51] Int. Cl.[3] ..... B26D 3/08; B26D 1/56; B26F 1/42

[52] U.S. Cl. ..... 83/887; 83/303; 83/346; 83/665

[58] Field of Search ..... 83/303, 346, 347, 881, 83/886, 887, 344, 648, 659, 665

[56] References Cited

U.S. PATENT DOCUMENTS

| | | | |
|---|---|---|---|
| 1,310,922 | 7/1919 | Novick | 83/346 |
| 2,815,077 | 12/1957 | Pechy | 83/665 |
| 3,119,312 | 1/1964 | Henc | 83/347 |
| 3,257,885 | 6/1966 | Hornung | 83/346 |
| 4,020,724 | 5/1977 | Quinlan | 83/346 |
| 4,074,599 | 2/1978 | Allen | 83/346 |
| 4,226,150 | 10/1980 | Reed | 83/346 |

FOREIGN PATENT DOCUMENTS

| | | | |
|---|---|---|---|
| 2332178 | 1/1975 | Fed. Rep. of Germany | 83/346 |

*Primary Examiner*—James G. Smith
*Assistant Examiner*—K. Bradford Adolphson
*Attorney, Agent, or Firm*—James E. Nilles

[57] ABSTRACT

A die cutter for a rotary cutting machine, which cutter comprises a hollow open ended cylinder. The cylinder can be mounted on a rotatable shaft in a rotary cutting machine for rotation with the shaft. The cylinder can be adjusted axially relative to the shaft so that the spacing between the said cylinder and other like cylinders also mounted on the shaft can be adjusted.

12 Claims, 5 Drawing Figures

CUTTER FOR ROTARY CUTTING MACHINE

REFERENCE TO RELATED CO-PENDING APPLICATION

This application is a continuation-in-part application from my pending U.S. Patent Application Ser. No. 146,661, filed May 5, 1980, abandoned after the filing hereof.

BACKGROUND OF THE INVENTION

1. Field of the Invention

This invention relates to a die cutter, and more particularly a rotary cutting machine and tool for production of all kinds of die cut labels.

2. Description of the Prior Art

The increasing use of computers for accounting and other repetetive operations has led to a corresponding increase in the employment of the computer print-out to print a label which is used for dispatch of an account or other material. The labels used are generally self-adhesive labels and they are presented to the computer print-out arranged on a continuous backing sheet in parallel rows. Not only in the field of computer labels can this system be used; it is flexible and can also be used to produce labels for automatic application onto any product from reels or sheets for the packaging industry, or any use as may be found for any label of any kind which is manufactured.

The production of such labels in the form aforesaid has hitherto been effected either by a discontinuous stamping operation which is very slow, or by a rotary die cutting machine in which a laminate comprising a self-adhesive material on a backing is led under a solid shaft having cutters thereon which cut through the self-adhesive material around predetermined areas defining the labels, but do not cut through the backing. The surplus self-adhesive material is then removed, leaving the backing with a succession of parallel transverse rows of labels.

Although the rotary cutting machine just described is considerably faster than stamping, it nevertheless has considerable disadvantages. There is no standardisation in computer print-out labels or the spacing between labels. If, therefore, the size of the label is to be changed or the spacing between the labels altered, then a different die cutter is required. These die cutters are very expensive, and a heavy capital investment is required if even a modest range of label sizes and spacings is to be produced.

A different, but equally serious disadvantage stems from the very precise depth of cutting that the device must provide. If the cut is not deep enough, then separate self-adhesive labels will not be formed. But if the cutter penetrates too far into the laminate, the entire laminate will be severed and it will not then be suitable for a computer print-out or any present labelling product. Due to the engraved outside diameter of the cutter, the cutter shaft can only be held at the ends thereof and there is consequently a slight bowing of the cutter shaft in its central region. In order to compensate for that bowing, the cutter shaft must be non-uniform, in that it must have a larger cross-section near the centre than at the ends. All this makes the cutter shaft very expensive and unstable, as it spins, because it is unsupportable. It becomes highly susceptible to speed and thrust, and consequently its accuracy and quality of production can be affected especially as it becomes older and more used.

SUMMARY OF THE INVENTION

The present invention has been made from a consideration of these problems and disadvantages.

According to the present invention there is provided a rotary cutting machine comprising including a rotatable cutter shaft, a hollow open ended cylinder having cutter blades on the outer surface thereof being removably mounted on said cutter shaft for rotation with said cutter shaft and further adapted for axial adjustment relative to the cutter shaft, an anvil roller associated with said cutter shaft, distance piece means removably mounted on said cutter shaft to determine the distance between said cutter shaft and said anvil roller, means intermediate the ends of said cutter shaft for urging the cutter shaft towards the anvil roller to maintain said cutter shaft and anvil roller in axially parallel spaced-apart relationship.

The invention also provides a rotary cutting machine having a plurality of cutters, as defined above, making an infinite width across the laminate, each said cutter being removably mountable on a different rotatable cutter shaft, an anvil roller associated with each cutter shaft or a common anvil which the die cutters are formed as satellites around the anvil removable distance piece means on each cutter shaft engaging the associated anvil roller to determine the distance between each cutter shaft and associated anvil roller and means intermediate the ends of each cutter shaft for urging the said cutter shaft towards its associated anvil roller to maintain each said cutter shaft and anvil roller in axially parallel, spaced-apart relationship.

BRIEF DESCRIPTION OF THE DRAWINGS

A specific embodiment of the invention will now be described by way of example with reference to the accompanying drawings in which.

DESCRIPTION OF THE PREFERRED EMBODIMENTS

Figure 1:
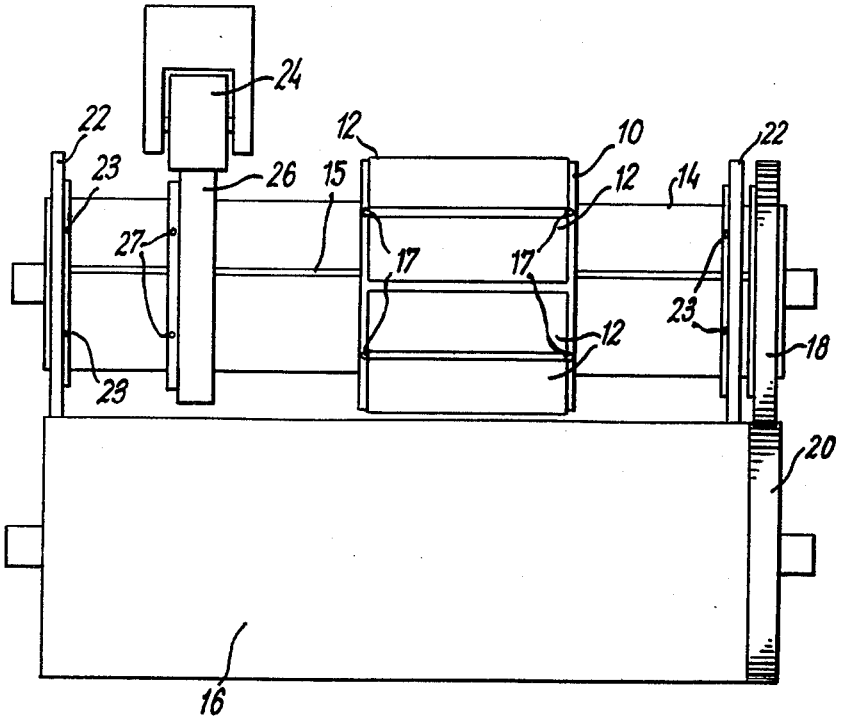
FIG. 1 shows diagrammatically in front elevation a part of a rotary cutting machine including a cutter of the invention.

Referring to FIG. 1 of the drawings, the cutter comprises a hollow open ended cylinder 10. A plurality of blades 12 project from the outer surface of the cylinder, each blade defining an area which corresponds to the shape of the label that the cutter will form. As can be seen in FIG. 1 the shaped cutter blades are arranged around the cylinder with their major axes parallel to the cylinder axis and with equal spacing between each cutter blade. Other configurations of blade and disposition thereof can be adopted if desired, however.

The cutter cylinder 10 is adapted to be mounted on a rotatable shaft 14 of a rotary cutting machine. The means by which the cylinder 10 is removably mounted on a shaft 14 is not critical and may comprise any suitable arrangement which permits the cylinder to be fixed to the shaft for rotation therewith and also adjustable axially of the shaft. A convenient fixing arrangement which also permits the adjustment aforesaid comprises a radially projecting rib 15 extending along the length of the shaft parallel to the shaft axis which is received in a keyway in the inner surface of the cutter cylinder 10. To fix the cutter cylinder in its desired position grub screws 17 are tightened on to the shaft 14.

It is preferred that the cutter should be used in combination with an anvil roller 16 adapted for rotation in the opposite sense to cutter shaft 14 by means of gears 18 and 20. The spacing between shaft 14 and roller 16 and hence between the cutters 12 and the rollers 16, is controlled by annular distance pieces 22 mounted on shaft 14 adjacent each end thereof and bearing against the surface of roller 16.

These distance pieces 22 are separate from the shaft 14 and can be removed from the shaft in order to allow cylinder 10 to be changed when desired. Each distance piece is formed with an internal keyway to receive the rib 15. The distance pieces 22 are fixed in position on the shaft by means of grub screws 23. The length of shaft 14 can be selected to suit any requirements.

In order to maintain the axis of the cutter shaft 14 parallel to that of the roller 16 at least over that part of the shaft 14 where the cutter 10 is mounted, the shaft 14 can be urged towards the roller 16 by means of a pressure roller 24 which bears against an annular sleeve 26 removably mounted on shaft 14. The force applied by roller 24 on sleeve 26 can be adjusted. In addition the position of roller 24 and sleeve 26 may also be adjusted relative to shaft 14 to accommodate for any adjustment of the position of cutter cylinder 10 relative to shaft 14 or removed when the cutter cylinder is to be changed. The sleeve 26 has an internal keyway to receive the rib 15 and is fixed in its desired position on shaft 14 by means of grub screws 27.

Figure 1A:
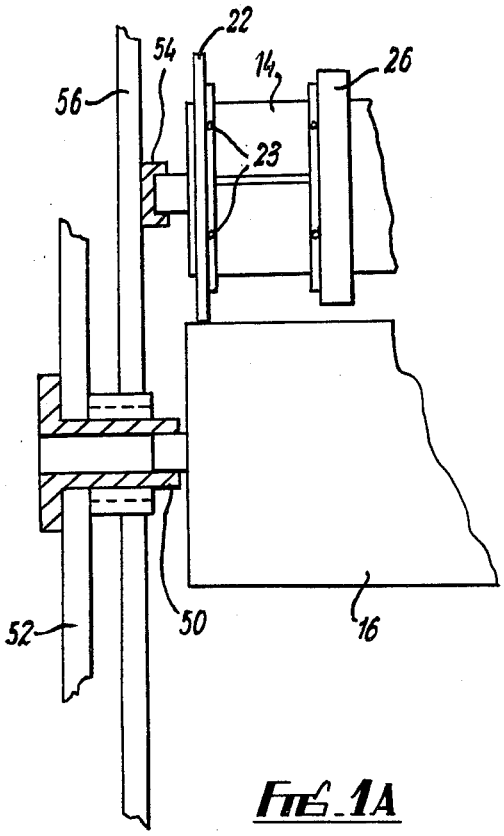
FIG. 1A illustrates diagrammatically how the shafts of FIG. 1 are journalled.

Referring now to FIG. 1A the roller 16 is journalled for rotation in a bearing 50 in the machine main frame 52. The cutter shaft 14 is journalled for rotation in bearing 54 on sub frame 56. The sub frame is movable relative to the main frame so as to free one end of the shaft 14 when the cutter is to be changed. Thus to change the cutter, having freed one end of shaft 14, distance piece 22 adjacent the freed end, sleeve 26 and the cutter cylinder are slackened off and slid axially along from the shaft. A different cutter can then be fitted on the shaft, the parts 26 and 22 replaced and the end shaft 14 repositioned for rotation. Fine adjustment of the parts may then be necessary in order to obtain the desired cutting action. Although FIG. 1A shows the bearings at one side of the machine a similar arrangement is provided at the other side.

The operation of the cutter and apparatus just described will now be illustrated by reference to FIGS. 2 and 3 and the production of computer print-out labels arranged in rows of three labels on a backing sheet, or however many may be required across by the end user or schedule planner for the machine and its operation.

A reel 30 of laminate consisting of self-adhesive label material 27 bonded to a release paper backing 28 is led, with the label material uppermost, successively through three pairs 32, 34 and 36 of cutter shaft and anvil roller arrangements as described with reference to FIG. 1. (It will be understood that FIG. 2 is only diagrammatic and that in practice the pairs of cutters and anvil rollers would be much closer together). Thus the cutter in the first pair 32 is positioned at the centre of cutter shaft and will cut out the centre column of labels 40. The cutter in the second pair 34 is positioned on the cutter shaft to cut out one outside column of labels, say column 42 and the cutter in the final pair 36 set on the cutter shaft to cut out the last column 44, or in such a way that the machine retains balance and regardless of the quantity of cutters used produces labels effectively.

It will be understood that the cutter is arranged so that it penetrates through the label material but not through the backing. The surplus label material is separated from the backing and wound up on reel 37 and the product as shown in FIG. 3 wound up on reel 38. As also shown in FIG. 3, the product is provided with slots 48 in the margins thereof. If necessary, these may be formed prior to or after label formation to give a useful means for advancing the laminate material through the rotary cutting machine.

If the spacing between the columns of labels requires alteration, that can be readily effected by axial adjustment of the cutter cylinders on their cutter shafts. Moreover it is also relatively simple to replace the cutter cylinders if different shaped labels are required.

Figure 2:
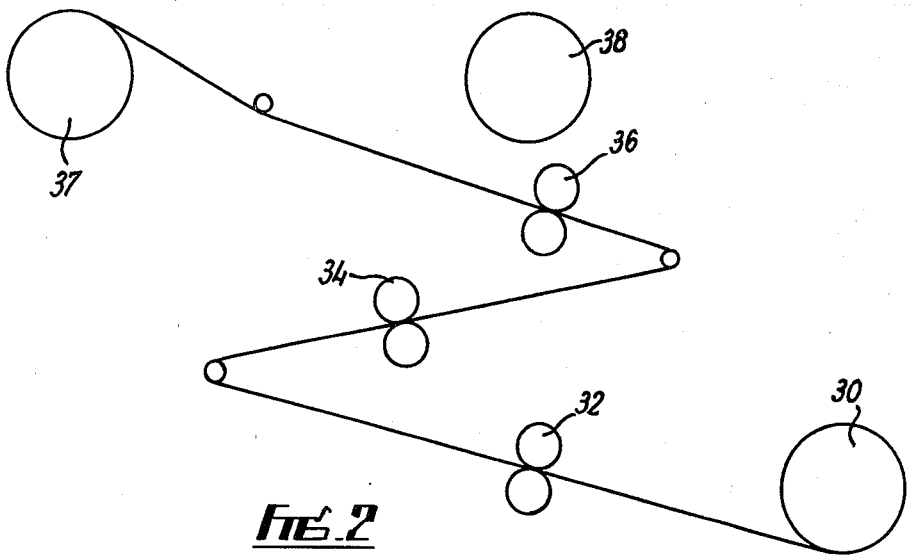
FIG. 2 is a diagrammatic illustration of the operation of the cutting machine.
Figure 3:
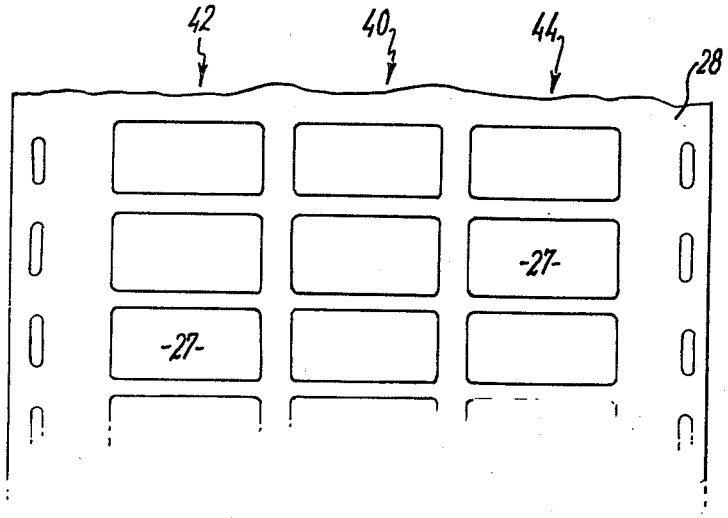
FIG. 3 shows the product made by the machine.
Figure 4:
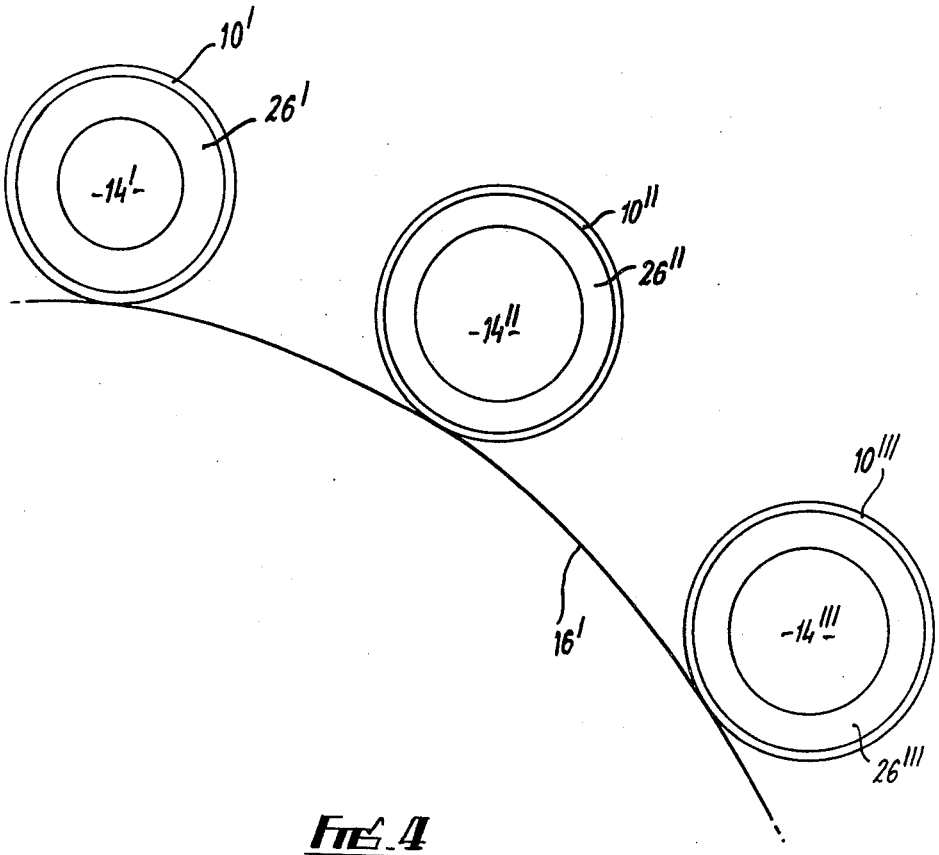
FIG. 4 is a diagrammatic representation of another embodiment.

Instead of separate pairs of cutters and anvil rollers as shown in FIG. 2 other arrangements can be adopted such as illustrated in FIG. 4 in which a single anvil roller 16' has a plurality of satellite cutter shafts 14', 14'' and 14''' around the periphery of the anvil roller, the cutter on each cutter shaft being set to produce a different column of labels. Alternatively each anvil roller may be associated with two cutter shafts, the laminate being led between each roller and one cutter and then back between the anvil rollers and the second cutter. Again, each cutter produces a different column of labels.

Although the production of computer print-out labels arranged in three columns has been described, it will be understood that the invention can be used to produce labels in any number of columns. In cases where the product is wide, or the machine is infinite in width and there are a large number of columns of labels, more than one cutter cylinder can be arranged on each cutter shaft, but more usually provision is taken within the machine design to incorporate the correct amount of anvils or satellites necessary and in relation to the production volume required.

What I claim is:

1. A rotary cutting machine comprising:

a main frame, a sub frame, bearing means on each of said frames, a rotatable cutter shaft journalled for rotation on the bearing means of the sub frame but removable therefrom, a hollow open ended cylinder having cutter blades on the outer surface thereof, the axial length of said cylinder being less than the axial length of the cutter shaft, said cylinder being removably mounted on said cutter shaft for rotation with said cutter shaft and further adapted for axial adjustment relative to the cutter shaft, an anvil roller journalled for rotation on the bearing means of the main frame and associated with said cutter shaft, distance piece means removably mounted on said cutter shaft and including a pair of distance pieces, each distance piece being removably mounted near an end of said cutter shaft for rotation therewith and bearing against the surface of said anvil roller to determine the distance between said cutter shaft and said anvil roller, gear means connected between said cutter shaft and said anvil roller, and means including an annular sleeve removably mounted intermediate a distance piece and an end of said cutter cylinder on said cutter shaft and rotatable therewith and a pressure roller bearing against said annular sleeve for urging the cutter shaft towards the anvil roller to maintain said cutter shaft and anvil roller in axially parallel spaced-apart relationship.

2. A cutter as claimed in claim 1, wherein each blade defines an area.

3. A cutter as claimed in claim 2, wherein the blades are arranged around the surface of the cylinder with equal spacing therebetween.

4. A cutter as claimed in claim 2, wherein the blades are arranged to form a single row of areas around the surface of the cylinder.

5. A cutter as claimed in claim 2, wherein the areas are of equal size.

6. A cutter as claimed in claim 2, wherein the areas are substantially rectangular in shape and have their major axes parallel to the cylinder axis.

7. A rotary cutting machine comprising:

a main frame, a sub frame, bearing means on each of said frames, a plurality of rotatable cutter shafts journalled for rotation on the bearing means of the sub frame but removable therefrom, a die cutter removably mounted on each cutter shaft for rotation therewith, each die cutter comprising a hollow open ended cylinder having cutting blades on the outer surface thereof, the axial length of said cylinder being less than the axial length of the cutter shaft, the inner surface of said cylinder being adapted for mounting on one of said cutter shafts and further adapted to be adjustable axially relative to said one shaft, an anvil roller journalled for rotation on the bearing means of the main frame and associated with each cutter shaft, distance piece means removably mounted on each cutter shaft and including a pair of distance pieces, each distance piece being removably mounted near an end of said cutter shaft for rotation therewith and bearing against the surface of said anvil roller to determine the distance between each cutter shaft and anvil roller, gear means connected between said cutter shaft and said anvil roller, and means including an annular sleeve removably mounted intermediate a distance piece and an end of said cutter cylinder on each cutter shaft and rotatable therewith and a pressure roller bearing against said annular sleeve for urging said cutter shaft towards its associated anvil roller to maintain said cutter shaft and anvil roller in axially parallel, spaced-apart relationship.

8. A rotary cutting machine as claimed in claim 7, wherein a separate anvil roller is provided for each cutter.

9. A rotary cutter as claimed in claim 7, wherein a common anvil roller is provided for a plurality of cutters.

10. A rotary cutting machine as claimed in claim 7, wherein means are provided for rotating an anvil roller in the opposite sense to its associated cutter shaft.

11. A rotary cutting machine as claimed in claim 7, wherein the pressure applied by the pressure roller is adjustable.

12. A rotary cutting machine comprising:

a main frame;

a pair of anvil roller bearings mounted in spaced apart relationship on said main frame;

an anvil roller journalled for rotation on said pair of anvil roller bearings;

an anvil roller gear fixedly mounted on one end of said anvil roller and rotatable therewith;

a sub frame;

means for mounting said sub frame in a fixed position relative to said main frame;

means for releasing a portion of said sub frame from its fixed position to allow it to be shifted relative to said main frame;

a pair of cutter shaft bearings mounted in spaced apart relationship on said sub frame;

a cutter shaft journalled for rotation on said pair of cutter shaft bearings;

a cutter shaft gear fixedly mounted on one end of said cutter shaft and rotatable therewith, said cutter shaft gear being in meshing engagement with said anvil roller gear whereby said cutter shaft and said anvil roller rotate together in opposite directions;

a hollow open ended cutter cylinder having cutter blades on the outer surface thereof, the axial length of said cutter cylinder being less than that of said cutter shaft, said cutter cylinder being slidably mountable on said cutter shaft to enable said cutter cylinder to be axially positioned in desired axial positions on said cutter shaft and to be axially removed from an end of said cutter shaft;

means for releasably securing said cutter cylinder in a desired axial position on said cutter shaft;

means for fixedly securing said cutter cylinder on said cutter shaft for rotation therewith;

distance piece means for determining the distance between said cutter shaft and said anvil roller, said distance piece means comprising a pair of distance pieces, one distance piece being slidably mountable near each end of said cutter shaft and bearing against the surface of said anvil roller, each distance piece being axially removable from an end of said cutter shaft;

means for releasably securing said distance pieces in axial positions near the ends of said cutter shaft;

means for fixedly securing said distance pieces on said cutter shaft for rotation therewith;

and means to maintain the axis of said cutter shaft parallel to the axis of said anvil roller at least along that part of said cutter shaft on which said cutter cylinder is mounted comprising:

an annular sleeve slidably mountable on said cutter shaft between an end of said cutter cylinder and one of said distance pieces and able to be axially positioned in desired axial positions on said cutter shaft and to be axially removed from an end of said cutter shaft;

means for releasably securing said annular sleeve in a desired axial position on said cutter shaft;

means for fixedly securing said annular sleeve on said cutter shaft for rotation therewith;

a pressure roller which bears against said annular sleeve and urges that part of the axis of said cutter shaft on which said cylinder is mounted into parallel relationship with the axis of said anvil roller;

and means for adjusting the force applied by said pressure roller to said annular sleeve.

* * * * *